US007717379B2

(12) United States Patent
Kimmel

(10) Patent No.: US 7,717,379 B2
(45) Date of Patent: May 18, 2010

(54) FURNITURE BALANCING APPARATUS

(76) Inventor: June Seley Kimmel, 90 Skyline Dr., Bernardsville, NJ (US) 07924

( * ) Notice: Subject to any disclaimer, the term of this patent is extended or adjusted under 35 U.S.C. 154(b) by 175 days.

(21) Appl. No.: 11/906,721

(22) Filed: Oct. 3, 2007

(65) Prior Publication Data

US 2009/0090823 A1 Apr. 9, 2009

(51) Int. Cl.
*F16M 11/24* (2006.01)

(52) U.S. Cl. ..... 248/188.2; 248/188.1; 248/346.05; 248/346.01

(58) Field of Classification Search ..... 248/188.2, 248/188.1, 188.3, 346.11, 188.8, 346.01, 248/346.2, 346.03, 346.05; 16/42 R, 17.1; 482/49

See application file for complete search history.

(56) References Cited

U.S. PATENT DOCUMENTS

| | | | | | |
|---|---|---|---|---|---|
| 133,766 | A | | 12/1872 | Easterly | 248/188.2 |
| D44,996 | S | | 12/1913 | Buser | D8/374 |
| 1,725,499 | A | | 8/1929 | Wetzel | 248/188.2 |
| 1,741,487 | A | | 12/1929 | Vance | 248/188.2 |
| 1,912,728 | A | | 6/1933 | Roe | 248/346.11 |
| 3,030,730 | A | | 4/1962 | Costar | 248/188.2 |
| 3,326,508 | A | * | 6/1967 | Born | 248/346.11 |
| 4,830,320 | A | | 5/1989 | Bellows | 248/188.2 |
| 5,081,740 | A | * | 1/1992 | Smith | 16/42 R |
| 5,220,705 | A | * | 6/1993 | Bushey | 16/42 R |
| D340,638 | S | | 10/1993 | Campbell | D8/374 |
| 5,249,767 | A | | 10/1993 | Mellen | 248/188.2 |
| 5,426,818 | A | * | 6/1995 | Bushey | 16/42 R |
| 5,802,669 | A | * | 9/1998 | Wurdack | 16/42 R |
| 5,924,661 | A | * | 7/1999 | Chernack | 248/188.2 |
| 6,206,424 | B1 | * | 3/2001 | Edwards et al. | 280/845 |
| 6,464,256 | B1 | * | 10/2002 | Edwards | 280/845 |
| 6,901,629 | B2 | * | 6/2005 | Wurdack | 16/42 R |
| D513,583 | S | | 1/2006 | Chase | D8/374 |
| 2003/0163894 | A1 | | 9/2003 | Jones et al. | 16/42 R |

* cited by examiner

*Primary Examiner*—J. Allen Shriver
*Assistant Examiner*—Todd M. Epps
(74) *Attorney, Agent, or Firm*—Ernest D. Buff & Associates, LLC; Ernest D. Buff; Margaret A. LaCroix

(57) ABSTRACT

A furniture balancing pad stabilizes a furniture piece having an uneven leg base or support surface. The furniture balancing pad comprises a biscuit portion having a top surface, a substantially flat bottom surface, and side walls. A flexible stabilization cushion having a central cushion thickness is attached to the top surface of the biscuit to form an outer perimeter shelf extending horizontally and adjacently in relation to the flexible stabilization cushion and adjacent to the side walls of the biscuit. This shelf acts as a support lip for the furniture piece. The outer perimeter shelf of the biscuit includes a perimeter thickness, or height, and a shelf depth. The flexible stabilization cushion and the biscuit may be constructed as a unitary pad. As arranged, the flexible stabilization cushion and the outer perimeter shelf of the biscuit level and buttress the uneven leg base or uneven surface when the furniture balancing pad is slid under the furniture piece.

17 Claims, 4 Drawing Sheets

FURNITURE BALANCING APPARATUS

BACKGROUND OF THE INVENTION

1. Field of the Invention

The present invention relates to a furniture balancing apparatus for providing a leveling affect to uneven furniture pieces or uneven floor surfaces supporting furniture pieces; and more particularly to a table/furniture balancing pad wherein a biscuit is integrated with a flexible stabilization cushion forming an outer perimeter shelf, so that the cushion compresses and deforms under the weight of the furniture and operates in concert with the outer perimeter shelf to level and stabilize the furniture piece.

2. Description of the Prior Art

Irregular floor or support surfaces, as well as the wear and/or other damage to furniture leg supports over time, often produces instability and wobbling of a furniture piece. Instability and unwanted wobbling of the furniture piece is annoying, and can contribute to accidents or injuries, such as those occasioned by hot liquid spills or when a furniture piece tips over. Structural damage to furniture can also result when uneven leg support effects uneven distribution of weight on parts of the furniture. Marring, scratching or wearing of a floor surface frequently results from continued use of an uneven furniture piece.

Various devices have been employed in attempts to level the furniture pieces, including simple objects such as match books, napkins, and the like. These devices tend to be temporary fixes and that are generally unsightly.

Other attempts to level furniture pieces have involved devices which must be fixedly attached to the furniture leg and/or the floor. Such devices are cumbersome to install and are unattractive. For example: U.S. Pat. No. 1,741,487 to Vance discloses readily stackable floor plates comprising a body of sheet metal having holes punched therethrough for securing the plates to the floor. A plurality of projecting buttons or lugs hold an angle iron leg in place on each plate. U.S. Patent Application Publication No. 2003/0163894 to Jones et al. discloses a self-leveling glide assembly including a glide housing appointed to be attached to a bottom of a furniture leg.

Still other leveling devices are appointed to be slid under an uneven leg of a furniture piece. These devices are typically constructed as wedges. They do not discretely blend with the furniture piece and can appear unattractive. For example: U.S. Pat. No. 3,030,730 to Costar discloses a leg height adjuster including a pair of identical wedges that mate with one another to provide height adjustment thereto, with each wedge having a frusta-spherical concavity so that the top wedge holds a bearing head of a leg while the bottom wedge suctions to the floor. U.S. Pat. No. 4,830,320 to Bellows discloses a wedge-shaped device adapted to stabilize an article of furniture formed with upper and lower surfaces having a plurality of transverse rib teeth. U.S. Pat. No. 5,249,767 to Mellen discloses a table leveling wedge having a cavity in the top surface thereof to confine a table glide therein. These wedge-type balancing devices must be wedged under the leg. They tend to appear rather unsightly and obtuse, jetting out from under the leg being supported. Moreover, the wedges are generally rigid in construct.

Some platforms or pads utilized to level furniture do not provide flexibility; but rather are rigid. U.S. Pat. No. 133,766 to Easterly discloses foot-platforms having a primary platform composed of cast metal. A central holding-surface, which may be flat, concave, or convex, has a ledge for confining the foot on a leg. The rigidity of the pad can cause the uneven leg to become higher than the other legs. This further contributes to the unevenness, as the pad itself cannot conform to the desired height adjustment. Even where rigid pads have provided for height adjustment, these devices are cumbersome to adjust and impractical for many uses. For example, U.S. Pat. No. 1,725,499 to Wetzel discloses an adjustable leveling device for scales. A supporting bar is adapted to be secured at each end to a circular disk-like member by means of screws. The rigidity of these platforms not only presents placement issues (i.e. height adjustability), but additionally causes the platforms to be highly visible and unsightly.

Even where flexible pads and the like have been provided, many of these pads involve constructs with a cavity surrounded by narrow side walls appointed to hold the leg in place. Many of these pads do not function to level a piece of furniture, but are merely shoes for covering the leg cap of the furniture, presumably to prevent the cap from scratching the floor. For example: U.S. Pat. No. 1,912,728 to Roe discloses a furniture support composed of a rubber material comprised of walls and a floor that is sloped to yield a depressed central point so that the central point does not contact the leg held by the support; U.S. Design Pat. No. D044996 to Buser discloses an ornamental design for a show or protecting tip for furniture-legs; U.S. Design Pat. No. D340638 to Campbell discloses an ornamental design for a furniture leg shoe design; and U.S. Design Pat. No. D513583 to Chase discloses an ornamental design for a furniture leg cap. Any leg appointed to be supported by these devices must be of a specific size and shape to fit properly within the cavity of the device. The side walls result in the inability to utilize the device when the leg does not fit perfectly within the confines thereof, otherwise the leg would be resting solely on the walls and the floor would not be supporting the leg whatsoever. As a result, the walls would eventually give way and buckle.

Additionally, U.S. Pat. No. 5,924,661 to Chernack discloses a stabilizing device having a first envelope formed of a pair of substantially rectangular sheet-like members joined along marginal edges, with a second envelope or bladder housed therein that is fabricated of a preferably elastically or otherwise resiliently deformable material within which a filler material is contained. This device does not include walls in general, and is merely a circular, egg shaped device appointed to deform under the weight of the furniture. However, due to the curved nature of the bottom of the device, the device can easily roll out from under the leg during insert, and may become dislodged as the leg is being placed down onto the structure. Moreover, the circular shape causes the overall thickness (i.e. diameter) of the device to be greater than would be accomplished with a thin disk, and so the furniture piece must be lifted higher to advance clearance for insertion.

Other types of pads for furniture pieces involve sliders appointed to be placed under the legs of a furniture piece for ease in sliding the furniture along a floor surface. These types of devices are not appointed for leveling the furniture piece, and are appointed for generally temporary use during moving. For example: U.S. Pat. No. 5,081,740 to Smith discloses a reconfigurable slide for supporting furniture being moved having an inflexible slide cup with sides extending upward and an inner surface appointed for accommodating a removable slide cup insert composed of closed-cell rubber and having a flat upper surface; and U.S. Pat. No. 5,426,818 to Bushey discloses a floor glide for moving furniture across a floor comprised of a concavo-convex sheet of material, such as disk, and a resilient adhesive pad located therein. These slides are large relative to a furniture leg to provide greater weight distribution for ease in moving the furniture piece.

Generally, the inflexible slide cup is composed of a rigid of slippery material, and the cup insert has a flat upper surface which collapses around a furniture leg placed thereon to provide resistance. The leg of the furniture piece is placed within the cup and rests against the insert; the sides and the insert of the cup are appointed to prevent the leg from sliding from the cup and do not bear weight rather than to support the leg, as any weight bearing on the cup walls would likely cause them to collapse. In any event, these devices are large in size so as to provide greater weight distribution and visa vie easier movement of the furniture piece. As a result, they would be quite unsightly and impractical for use when attempting to level the furniture piece.

Notwithstanding the efforts of prior art workers to construct devices for leveling uneven furniture pieces, there remains a need in the art for a thin resilient, flexible furniture balancing pad that can be readily slid under an uneven leg with minimum lifting clearance. In addition, there exists an art recognized need for a table balancing pad having a flexible stabilizing cushion that deforms upon placement of a leg base. Moreover, there is a need in the art for a table balancing pad wherein an outer perimeter area substantially surrounds the flexible stabilizing cushion so that weight from the furniture piece is distributed on the cushion and the surrounding perimeter, allowing the pad to be readily slid under the uneven leg of a chair, table, or stool to provide immediate relief for the instability problem.

SUMMARY OF THE INVENTION

The present invention provides a thin resilient, flexible furniture balancing pad that can be readily slid under an uneven leg with minimum lifting clearance. The table balancing pad includes a flexible stabilizing cushion that deforms upon placement of a leg base. An outer perimeter area is provided that substantially surrounds the flexible stabilizing cushion. Weight form the furniture piece is distributed on the cushion and the surrounding perimeter to provide immediate relief for the instability problem. Advantageously, the table balancing pad solves instability problems in a convenient, attractive manner. The user simply slides the stabilization pad under the uneven leg and stabilization of the uneven furniture piece is achieved in an aesthetic, discrete manner.

The furniture balancing pad for stabilizing a piece of furniture having an uneven leg base or support surface comprises a biscuit portion. This biscuit is constructed having a top surface, a substantially flat bottom surface, and side walls. A flexible stabilization cushion is attached to the top surface of the biscuit to form an outer perimeter shelf extending horizontally and adjacently in relation to the flexible stabilization cushion and adjacent to the side walls of the biscuit. This shelf acts as a support lip for the furniture piece. The outer perimeter shelf of the biscuit includes a perimeter thickness, or height, and a shelf depth (horizontal). A central cushion thickness is given to the flexible stabilization cushion. This central cushion thickness is greater than or less than the perimeter thickness of the outer perimeter shelf. As arranged, the flexible stabilization cushion and the outer perimeter shelf of the biscuit are appointed to level and buttress the uneven leg base or uneven surface when the furniture balancing pad is slid under the piece of furniture.

The biscuit may be composed of a rigid material, while the flexible stabilization cushion is composed of a flexible rubber or foam material. Optionally, the biscuit is composed of a flexible rubber material along with the flexible stabilization cushion. The pad may be constructed as a single pad wherein the biscuit and flexible stabilization cushion are integrated together during manufacturing. Alternatively, the flexible stabilization cushion may be removable and replacement cushions may be provided to replace cushions damaged or deformed over time. The furniture balancing pad can come in an array of sizes and shapes. In addition, the furniture balancing pad can come in an array of textures and colors so that the pad blends or camouflages with the furniture piece in an aesthetic, low profile manner. The perimeter thickness of the outer perimeter shelf of the biscuit may be less than the central cushion thickness of the flexible stabilization cushion so that the flexible stabilization cushion extends above the outer perimeter shelf. On the other hand, the perimeter thickness of the outer perimeter shelf of the biscuit is greater than the central cushion thickness of the flexible stabilization cushion so that the flexible stabilization cushion extends below the outer perimeter shelf.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

A furniture balancing pad for stabilizing a piece of furniture having an uneven leg base or support surface is provided by the present invention. Leveling and stability of the uneven furniture piece is achieved through utilization of a thin resilient, flexible furniture balancing pad that can be readily slid under an uneven leg with minimum lifting clearance needed. The table balancing pad includes a flexible stabilizing cushion that deforms upon placement of a leg base. An outer perimeter area is provided that substantially surrounds the flexible stabilizing cushion so that weight form the furniture piece is distributed on the cushion and the surrounding perimeter to provide immediate relief for the instability problem. Advantageously, the table balancing pad solves instability problems in a convenient, attractive manner. The user simply slides the stabilization pad under the uneven leg and stabilization of the uneven furniture piece is achieved in an aesthetic, discrete manner.

Figure 1A:
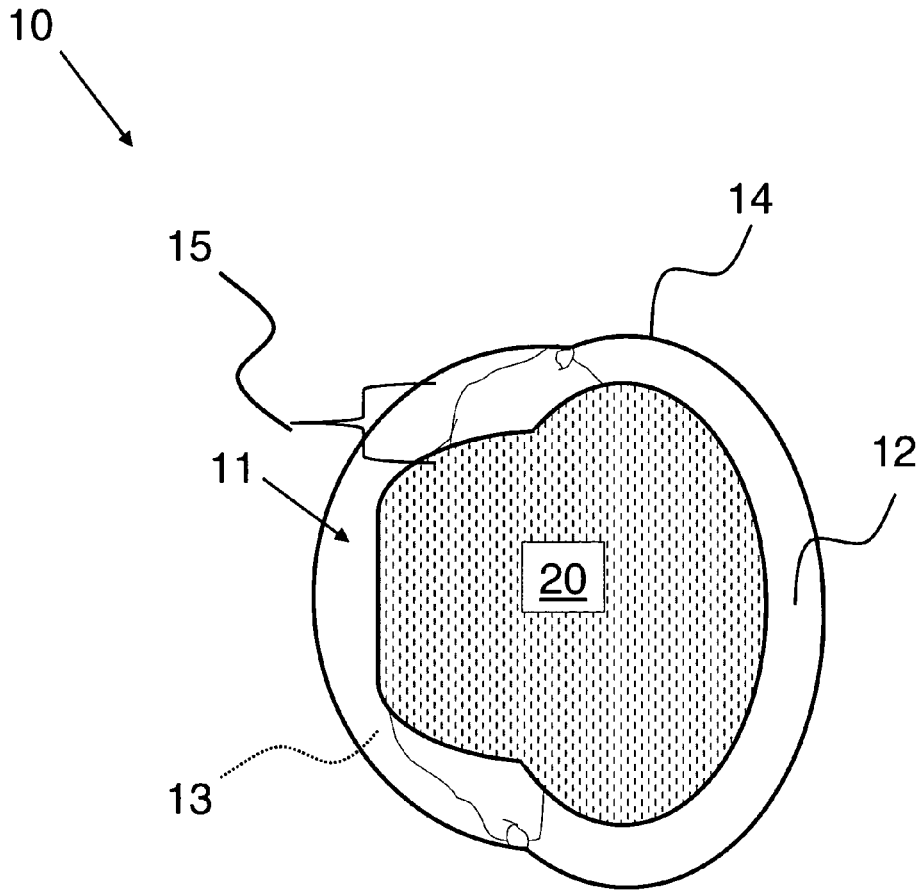
FIG. 1*a* illustrates a top view of an embodiment of the table/furniture balancing pad wherein the central cushion thickness of the flexible stabilization cushion is greater than the perimeter thickness of the surrounding outer perimeter shelf of the biscuit.
Figure 1B:
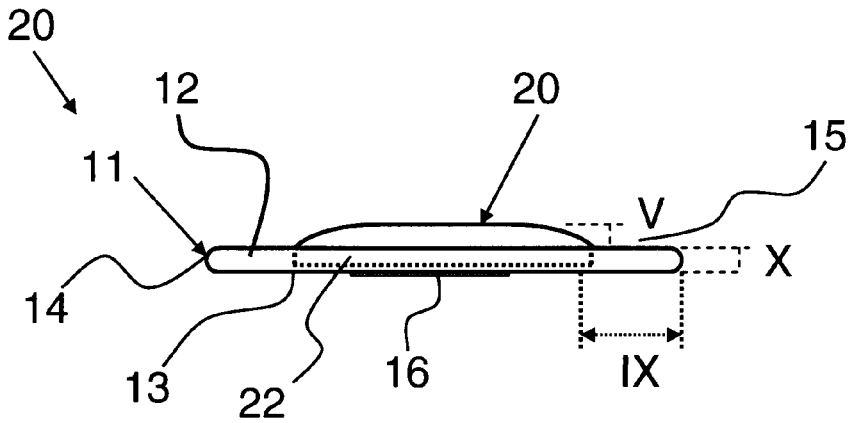
FIG. 1*b* illustrates a side view of the embodiment shown in FIG. 1*a;*
Figure 1C:
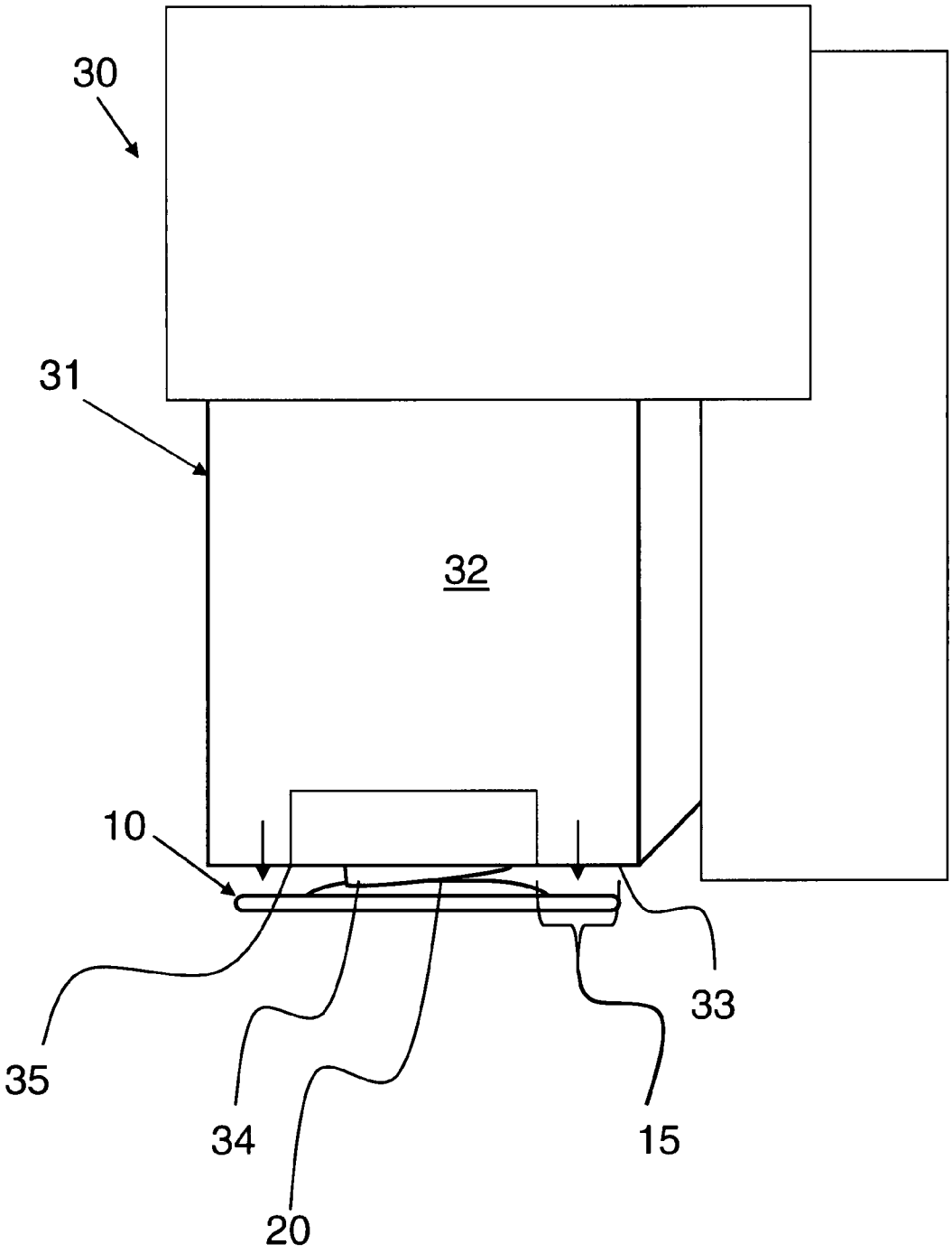
FIG. 1*c* illustrates a cross-sectional side view of a table leg/furniture leg being supported and leveled by the furniture balancing pad shown in FIGS. 1*a* and 1*b;*

FIGS. 1*a* and 1*b* illustrate views of an embodiment of the furniture/table balancing pad wherein the central cushion thickness of the flexible stabilization cushion is greater than the perimeter thickness of the surrounding outer perimeter shelf of the biscuit. FIG. 1*a* illustrates a top view shown generally at 10, while FIG. 1*b* illustrates a side view of the pad shown generally at 20. FIG. 1*c* illustrates implementation of the embodiment of FIGS. 1*a* and 1*b* with the leg of a furniture piece, such as a table, shown generally at 30. Furniture balancing pad 10 is appointed to be slid or placed under an uneven surface of a piece of furniture, such as a table leg, chair or stool, to even the furniture out so that it is balanced. In referring to FIGS. 1*a*, 1*b* and 1*c*, furniture balancing pad 10 comprises a biscuit portion 11 having a top surface 12, a substantially flat bottom surface 13, and side walls 14. Preferably, flat bottom surface 13 of biscuit 11 includes a friction coating 16. This coating 16 may comprise a polymeric coating, rough surface, or other frictional surfaces and is utilized to mitigate slippage of pad 10 when it is under the furniture piece.

A flexible stabilization cushion 20 is attached to top surface 12 of biscuit 11 to form an outer perimeter shelf 15 extending horizontally and adjacently in relation to flexible stabilization cushion 20 and adjacent to side walls 14 of biscuit 11. Flexible stabilization cushion 20 may have a thickness equal to, greater than, or less than the thickness of the outer perimeter shelf 15/biscuit 11. Outer perimeter shelf 15 of biscuit 11 includes a perimeter thickness X, or height, and a shelf depth IX (horizontal). A central cushion thickness V is given to flexible stabilization cushion 20. This central cushion thickness V is greater than or less than perimeter thickness X of outer perimeter shelf 15. In this embodiment central thickness V is greater than the perimeter thickness X.

As arranged, flexible stabilization cushion 20 and outer perimeter shelf 15 of biscuit 11 are appointed to level and buttress an uneven leg base 33 or uneven surface when furniture balancing pad 10 is slid under leg base 33 of a piece of furniture 31. Shelf 15 acts as a support lip for the furniture piece as can be seen in FIG. 1*c*. As shown in FIG. 1*c*, furniture 31 has a leg 32 with a leg base 33. Leg base 33 has a foot 34 with a foot periphery 35 there around. In this figure, foot 34 has been worn so that it is uneven, thus causing piece of furniture 31 to become wobbly, unstable, and in need of leveling. Pad 10 is simply slid under foot 34 as leg 32 is lifted slightly. Upon insertion of pad 10, leg 32 is released and the weight of furniture 31 is applied to flexible stabilization pad 20, thereby deforming it as indicated in FIG. 1*c*. As flexible stabilization pad 20 is deformed, foot periphery 35 of leg base 33 bears down on outer perimeter shelf 15 to stabilize and level furniture piece 31.

Biscuit 20 may be composed of a rigid material. Preferably, biscuit 20 may be composed of a flexible rubber material. Flexible stabilization cushion 20 is preferably composed of a flexible, resilient rubber or foam material. Most preferably, furniture biscuit 11 and flexible stabilization cushion 20 are composed of a highly durable rubber material and manufactured as a single pad 10. Alternatively, flexible stabilization cushion 20 is removably attached to biscuit 11 and replacement cushions 20 are available or provided. Furniture balancing pad 10 may be square in shape, circular, oval, semicircular, crescent, or biscuit shaped (as shown in FIG. 1*a*-1*c*). Moreover, the pad 10 visa vie biscuit 11 and flexible stabilization cushion 20 may be manufactured in a plethora of colors and textures so that pad 10 can blend with the furniture piece in a discrete manner. Colors may include brown, black, grey, white, and/or tan to name a few; and the textures may include smooth, glossy, wood-grained, and metallic.

Preferably, the flexible stabilization cushion 20 is located centrally on biscuit 11 so that outer perimeter shelf 15 surrounds flexible stabilization cushion 20. Perimeter thickness X of outer perimeter shelf 15 of biscuit 20 is less than central cushion thickness V of flexible stabilization cushion 20 in FIG. 1*a*-1*c*, so that flexible stabilization cushion 20 extends above outer perimeter shelf 15. Also, flexible stabilization cushion 20 is herein shown as arcuate and convex. In this manner, flexible stabilization cushion 20 can readily glide under the foot or base of the leg without sharp edges interfering and deforming. The perimeter thickness X of outer perimeter shelf 15 preferably ranges from 0.025 inches to 1 inch, and central cushion thickness V of flexible stabilization cushion 20 preferably ranges from 0.025 inches to 1 inch. Shelf depth IX of outer perimeter shelf 15 preferably ranges from 0.025 inches to 2 inches. As such, pad 10 is sized to easily be slid under a furniture leg after lifting the furniture piece only slight.

Cushion 20 may end at top 12 of biscuit 11 or extend downward within biscuit 11 as is shown in FIG. 1*b* at 22. In this manner, cushion 20 can be thicker without impacting the overall height of pad 10, thus enabling pad 10 to remain thinner for easier insertion under the leg of the furniture (i.e. lessens the lifting distance needed for insertion).

Figure 2A:
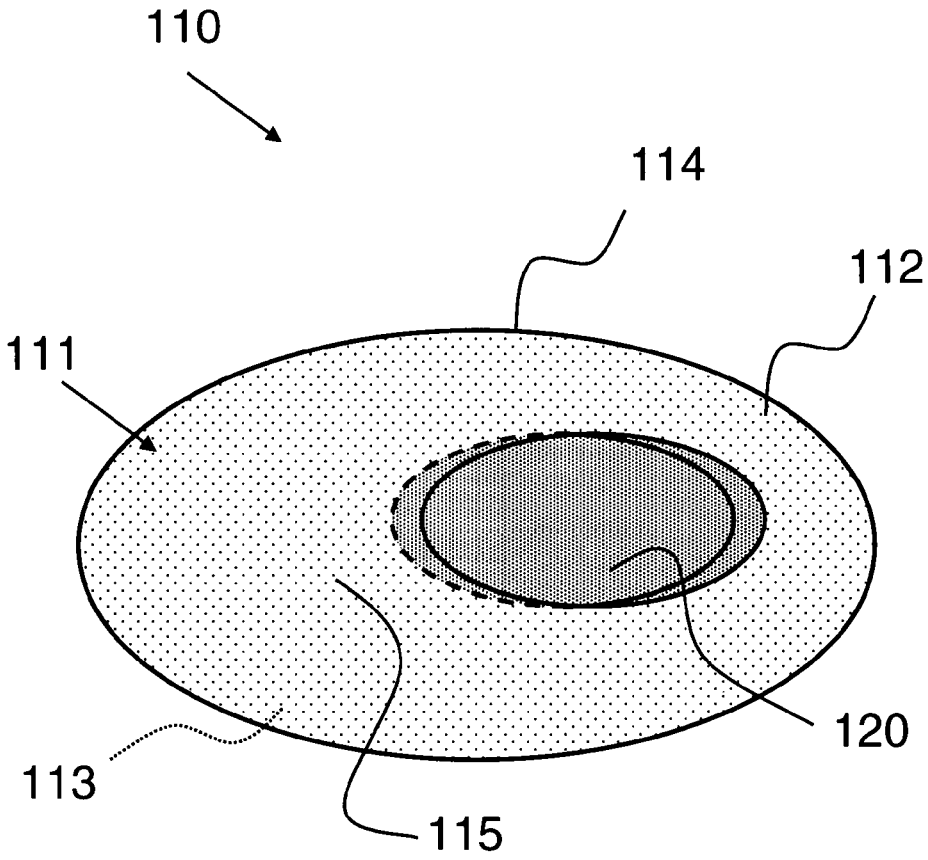
FIG. 2*a* illustrates a top view of another embodiment of the table/furniture balancing pad wherein the central cushion thickness of the flexible stabilization cushion is less than the perimeter thickness of the surrounding outer perimeter shelf of the biscuit.
Figure 2B:
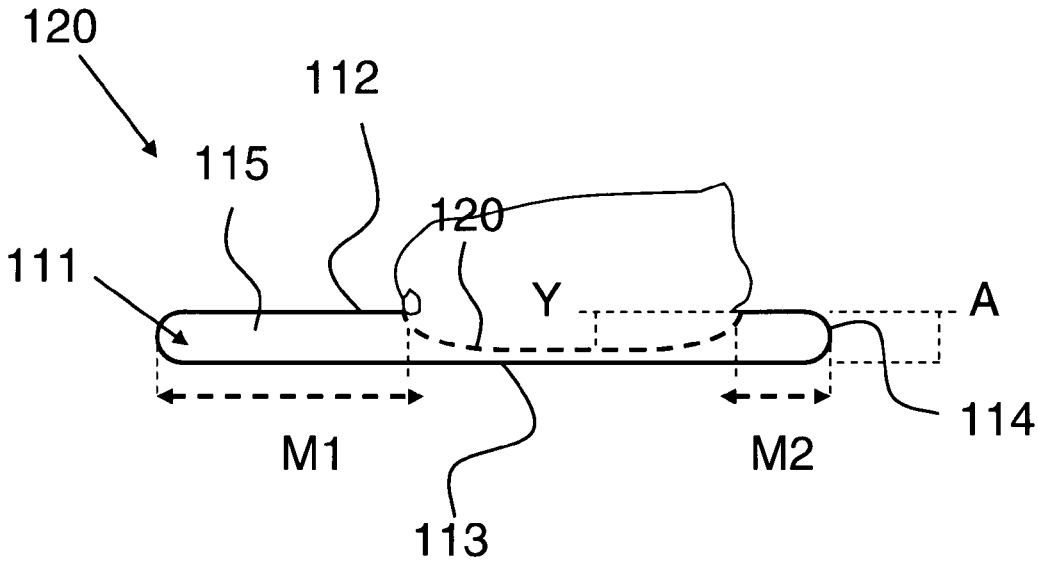
FIG. 2*b* illustrates a side view of the embodiment shown in FIG. 2*a*.

FIGS. 2*a* and 2*b* illustrate views of another embodiment of the furniture/table balancing pad wherein the central cushion thickness of the flexible stabilization cushion is less than the perimeter thickness of the surrounding outer perimeter shelf of the biscuit. FIG. 1*a* illustrates a top view shown generally at 100, while FIG. 2*b* illustrates a side view of the pad shown generally at 120. FIG. 1*c* illustrated implementation of the embodiment of FIGS. 1*a* and 1*b* with the leg of a furniture piece, such as a table, being supported and leveled by the furniture balancing pad shown in FIGS. 2*a* and 2*b*, shown generally at 130. Furniture balancing pad 100 is appointed to be slid or placed under an uneven surface of a piece of furniture 131, such as a table leg 132, chair or stool, to even the furniture out so that it is balanced. A flexible stabilization cushion 120 is built-into the body of top surface 112 of biscuit 111 to form an outer perimeter shelf 115 extending horizontally and adjacently in relation to flexible stabilization cushion 120 and adjacent to side walls 114 of biscuit 111. Flexible stabilization cushion 120 is preferably arcuate and concave so that a foot associated with a base of said leg of a furniture piece is received in concave flexible stabilization cushion 120 and the base of the leg is distributed on shelf depth M1, M2 of outer perimeter shelf 115.

Figure 2C:
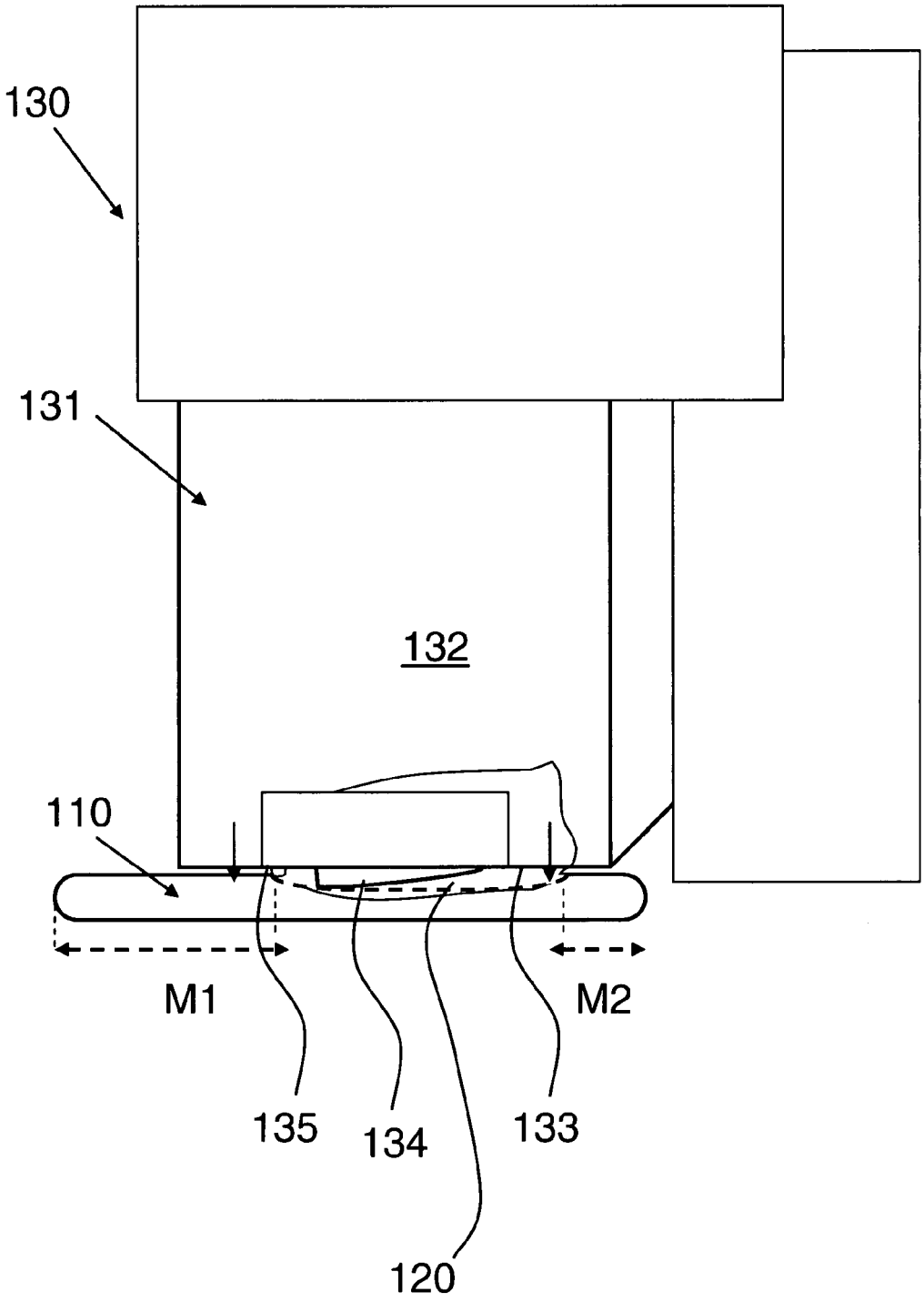
FIG. 2*c* illustrates a cross-sectional side view of a table leg/furniture leg being supported and leveled by the furniture balancing pad shown in FIGS. 2*a* and 2*b.*

Outer perimeter shelf 115 of biscuit 111 includes a perimeter thickness A, or height, and a shelf depth M (M1, M2). Herein, biscuit 111 has an oval shape and stabilization cushion 120 is placed on the side thereof so that the shelf depth M of outer perimeter shelf 115 is different, showing as M1, and M2. In this embodiment central thickness Y is less than the perimeter thickness A to form an indent for accommodating a foot of furniture's leg (FIG. 2*c*).

Flexible stabilization cushion 120 and outer perimeter shelf 115 of biscuit 111 are appointed to level and buttress an uneven leg base 133 or uneven surface when furniture balancing pad 110 is slid under leg base 133 of a piece of furniture 131. Shelf 115 acts as a support lip for the furniture piece as can be seen in FIG. 2*c*. As shown in FIG. 2*c*, furniture 131 has a leg 132 with a leg base 133. Leg base 133 has a foot 134 with a foot periphery 135 there around. In this figure, foot 314 has been worn so that it is uneven, thus causing piece of furniture 131 to become wobbly, unstable, and in need of leveling. Pad 110 is simply slid under foot 134 as leg 132 is lifted slightly. Upon insertion of pad 110, leg 132 is released foot 134 engages in concave flexible stabilization pad 120 and weight bears against the pad, deforming same. Foot periphery 135 then bears weight on outer perimeter shelf 115 to stabilize and level furniture piece 131.

The furniture balancing pad may be constructed so that the biscuit is composed of a rigid material while the flexible stabilization pad is composed of a flexible rubber or foam material. Preferably, both the biscuit and the flexible stabilization pad are constructed of a flexible rubber material manufactured as a single, unitary body. Furniture balancing pad 110 may be square in shape, circular, oval (as shown in FIG. 2*a*-2*c*), semi-circular, crescent, or biscuit shaped. Moreover, the pad 110 visa vie biscuit 111 and flexible stabilization cushion 120 may be manufactured in a plethora of colors and textures so that pad 110 can blend with the furniture piece in a discrete manner. The perimeter thickness A of outer perimeter shelf 115 preferably ranges from 0.025 inches to 1 inch, and central cushion thickness Y of flexible stabilization cushion 120 preferably ranges from 0.025 inches to 1 inch. Shelf depth M1, M2 of outer perimeter shelf 115 preferably ranges from 0.025 inches to 2 inches. As such, pad 110 is sized to easily be slid under a furniture leg after lifting the furniture piece only slight. Preferably Y is ⅛ inch from the inner edge of outer perimeter shelf 115. Pad 110 is preferably composed of a highly durable rubber material, with biscuit 111 and stabilization cushion 120 manufactured as a single pad 110; and can come in an array of sizes, shapes, and colors.

Although the figures hereinabove show application of the furniture balancing pad with a leg having a foot or shoe thereon, the pad can be readily utilized on a leg that does not have a foot or shoe. In such a manner, for example, the flat base of the leg engages with the flexible stabilization pad causing same to deform. The periphery around the flat base (relative to the portion engaging the flexible stabilization pad) abuts and engages with the outer perimeter shelf of the biscuit and weight is distributed on same.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A furniture balancing pad for stabilizing a piece of furniture having an uneven leg base or support surface, comprising:

a. a biscuit having a top surface, a flat bottom surface, and side walls, wherein said flat bottom surface of said biscuit includes a friction coating;

b. a flexible stabilization cushion attached to said top surface of said biscuit to form an outer perimeter shelf located within extending horizontally and adjacently in relation to said flexible stabilization cushion and adjacent to said side walls of said biscuit; and c. said outer perimeter shelf having a perimeter thickness and a shelf depth, said flexible stabilization cushion having a central cushion thickness;

wherein said flexible stabilization cushion and said outer perimeter shelf of said biscuit are appointed to level and buttress said uneven leg base or uneven surface when said furniture balancing pad is placed under said piece of furniture; and wherein said friction coating located on said flat bottom surface of said biscuit is appointed to mitigate sliding of said furniture balancing pad and visa vie said piece of furniture.

2. A furniture balancing pad as recited by claim 1, wherein said biscuit is composed of a rigid material.

3. A furniture balancing pad as recited by claim 1, wherein said biscuit is composed of a flexible rubber material.

4. A furniture balancing pad as recited by claim 1, wherein said flexible stabilization cushion is composed of a flexible, resilient rubber material.

5. A furniture balancing pad as recited by claim 1, wherein said flexible stabilization cushion is composed of a flexible, resilient foam material.

6. A furniture balancing pad as recited by claim 1, wherein said flexible stabilization cushion is located centrally on said biscuit and said outer perimeter shelf surrounds said flexible stabilization cushion.

7. A furniture balancing pad as recited by claim 1, wherein said perimeter thickness of said outer perimeter shelf of said biscuit is less than said central cushion thickness of said flexible stabilization cushion so that said flexible stabilization cushion extends above said outer perimeter shelf.

8. A furniture balancing pad as recited by claim 1, wherein said flexible stabilization cushion is arcuate and convex.

9. A furniture balancing pad as recited by claim 1, wherein said perimeter thickness of said outer perimeter shelf of said biscuit is greater than said central cushion thickness of said flexible stabilization cushion so that said flexible stabilization cushion extends below said outer perimeter shelf.

10. A furniture balancing pad as recited by claim 9, wherein said flexible stabilization cushion is arcuate and concave so that a foot associated with a base of said leg of said furniture piece is received in said concave flexible stabilization cushion and said base is distributed on said shelf depth of said outer perimeter shelf.

11. A furniture balancing pad as recited by claim 1, wherein said biscuit and said flexible stabilization cushion are composed of a highly durable rubber material and manufactured as a single pad.

12. A furniture balancing pad as recited by claim 1, wherein said flexible stabilization cushion is removably attached to said biscuit and replacement cushions are available or provided.

13. A furniture balancing pad as recited by claim 1, wherein said biscuit and said flexible stabilization cushion is colored and textured to blend with said furniture piece in a discrete manner, said colors including brown, black, grey, white, and/or tan and said textures including smooth, glossy, wood-grained, and metallic.

14. A furniture balancing pad as recited by claim 1, wherein said perimeter thickness of said outer perimeter shelf ranges from 0.025 inches to 1 inch, and wherein said central cushion thickness of said flexible stabilization cushion ranges from 0.025 inches to 1 inch.

15. A furniture balancing pad as recited by claim 1, wherein said shelf depth of said outer perimeter shelf ranges from 0.025 inches to 2 inches.

16. A furniture balancing pad as recited by claim 1, wherein said biscuit and said flexible stabilization cushion are square in shape.

17. A furniture balancing pad as recited by claim 1, wherein said biscuit and said flexible stabilization cushion are oval or semi-circular in shape.

* * * * *